US010907872B2

(12) United States Patent
Choi

(10) Patent No.: US 10,907,872 B2
(45) Date of Patent: Feb. 2, 2021

(54) REFRIGERATOR

(71) Applicant: LG ELECTRONICS INC., Seoul (KR)

(72) Inventor: Hojin Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 276 days.

(21) Appl. No.: 14/978,902

(22) Filed: Dec. 22, 2015

(65) Prior Publication Data

US 2016/0178245 A1 Jun. 23, 2016

(30) Foreign Application Priority Data

Dec. 23, 2014 (KR) ..... 10-2014-0187426

(51) Int. Cl.
*F25B 49/02* (2006.01)
*F25D 11/02* (2006.01)
(Continued)

(52) U.S. Cl.
CPC ..... *F25B 49/027* (2013.01); *F25B 47/022* (2013.01); *F25D 11/022* (2013.01);
(Continued)

(58) Field of Classification Search
CPC ..... F25B 2600/111; F25D 11/022
(Continued)

(56) References Cited

U.S. PATENT DOCUMENTS 2,705,404 A * 4/1955 Malutich ..... F25B 49/027 62/184
3,984,223 A * 10/1976 Whistler, Jr. ..... F25D 21/04 62/81

(Continued)

FOREIGN PATENT DOCUMENTS

CN 1242500 1/2000
CN 1752677 3/2006

(Continued)

OTHER PUBLICATIONS

CN-1752677 translation (Year: 2006).*

(Continued)

*Primary Examiner* — Christopher R Zerphey
(74) *Attorney, Agent, or Firm* — Fish & Richardson P.C.

(57) ABSTRACT

A refrigerator includes a first compressor configured to compress a first refrigerant, a first condenser configured to return the first refrigerant to the first compressor during a freezing cycle, a second compressor configured to compress a second refrigerant, and a second condenser configured to return the second refrigerant to the second compressor during a refrigerating cycle. The refrigerator includes a controller configured to control a radiating fan for the first condenser and the second condenser based on an operation state of the first compressor and the second compressor, and a refrigerant loop channel configured to allow the first refrigerant passing through a refrigerant channel that is located between a body and a door of the refrigerator. The refrigerant channel is coupled to the first condenser, and, for a predetermined time interval, an average operation time of the freezing cycle is longer than an average operation time of the refrigerating cycle.

18 Claims, 7 Drawing Sheets

(51) Int. Cl.

| | |
|---|---|
| ***F25D 21/04*** | (2006.01) |
| ***F25B 47/02*** | (2006.01) |
| ***F25D 19/04*** | (2006.01) |
| ***F25D 29/00*** | (2006.01) |
| ***F25B 7/00*** | (2006.01) |
| ***F25D 17/06*** | (2006.01) |
| ***F25D 21/00*** | (2006.01) |

(52) U.S. Cl.
CPC ..... *F25D 19/04* (2013.01); *F25D 21/008* (2013.01); *F25D 21/04* (2013.01); *F25B 2400/06* (2013.01); *F25B 2700/02* (2013.01); *F25B 2700/15* (2013.01)

(58) Field of Classification Search
USPC ..... 62/231
See application file for complete search history.

(56) References Cited

U.S. PATENT DOCUMENTS

| | | | | | |
|---|---|---|---|---|---|
| 5,138,844 | A * | 8/1992 | Clanin | F25B 49/027 | 62/180 |
| 6,666,043 | B2 * | 12/2003 | Lee | F25D 21/04 | 62/277 |
| 7,448,226 | B2 * | 11/2008 | Yamashita | F25B 5/02 | 236/DIG. 9 |
| 8,418,486 | B2 * | 4/2013 | Taras | F24F 3/153 | 62/173 |
| 8,793,003 | B2 * | 7/2014 | Laughman | F25B 49/02 | 62/215 |
| 8,813,511 | B2 * | 8/2014 | Kopko | F25B 49/027 | 62/181 |
| 8,984,902 | B2 * | 3/2015 | Junge | F25D 21/04 | 62/183 |
| 9,625,197 | B2 * | 4/2017 | Sugiyama | F25B 1/005 | |
| 9,696,076 | B2 * | 7/2017 | Prins | F25B 49/027 | |
| 2003/0209025 | A1 | 11/2003 | Lee | | |
| 2004/0134205 | A1 * | 7/2004 | Park | F25B 13/00 | 62/151 |
| 2006/0174640 | A1 * | 8/2006 | Caskey | F25B 49/027 | 62/183 |
| 2007/0113567 | A1 * | 5/2007 | Ahn | F25D 17/042 | 62/186 |
| 2007/0256437 | A1 * | 11/2007 | Singh | F25B 49/027 | 62/181 |
| 2009/0165496 | A1 * | 7/2009 | Zhang | F25B 9/14 | 62/498 |
| 2012/0291984 | A1 * | 11/2012 | Li | F24F 11/77 | 165/11.1 |
| 2013/0047659 | A1 * | 2/2013 | Kim | F25D 11/022 | 62/441 |
| 2013/0139529 | A1 * | 6/2013 | Lu | F25D 17/06 | 62/89 |
| 2014/0007610 | A1 * | 1/2014 | Jeon | F25D 11/02 | 62/419 |
| 2014/0157805 | A1 * | 6/2014 | Kwon | F25D 21/04 | 62/89 |

FOREIGN PATENT DOCUMENTS

| | | | |
|---|---|---|---|
| CN | 1752677 | A * | 3/2006 |
| CN | 101846432 | | 9/2010 |
| CN | 102967104 | | 3/2013 |
| EP | 1407700 | | 4/2004 |
| EP | 2565564 | | 3/2013 |
| KR | 10-2013-0024210 | | 3/2013 |
| KR | 10-2013-0088430 | | 8/2013 |
| KR | 10-2014-0097863 | | 8/2014 |
| KR | 10-2014-0113076 | | 9/2014 |

OTHER PUBLICATIONS

Extended European Search Report issued in European Application No. 15202276.0 dated Apr. 22, 2016, 7 pages.
Chinese Office Action in Chinese Application No. 201510971210.X, dated Sep. 4, 2017, 15 pages (with English translation).

* cited by examiner

REFRIGERATOR

CROSS-REFERENCE TO RELATED APPLICATION

Pursuant to 35 U.S.C. § 119(a), this application claims the benefit of earlier filing date and right of priority to Korean Application No. 10-2014-0187426, filed on Dec. 23, 2014, the contents of which is incorporated by reference herein in its entirety.

TECHNICAL FIELD

The present disclosure relates to a refrigerator, and more particularly, to a device for controlling a mechanical chamber fan of a refrigerator and a method for controlling the same.

BACKGROUND

A refrigerator is an apparatus keeping foods fresh using cold air generated by a refrigeration cycle. For example, a refrigerator may include a compressor, a condenser, an expansion valve, and an evaporator.

SUMMARY

In general, one innovative aspect of the subject matter described in this specification can be embodied in a refrigerator including a first compressor configured to compress a first refrigerant; a first condenser configured to return the first refrigerant to the first compressor during a freezing cycle; a second compressor configured to compress a second refrigerant; a second condenser configured to return the second refrigerant to the second compressor during a refrigerating cycle, wherein the refrigerating cycle is independent from the freezing cycle; a controller configured to control a radiating fan for the first condenser and the second condenser based on an operation state of the first compressor and the second compressor; and a hot refrigerant loop channel configured to allow the first refrigerant passing through a refrigerant channel that is located between a body and a door of the refrigerator, wherein the refrigerant channel is coupled to the first condenser, and wherein, for a predetermined time interval, an average operation time of the freezing cycle is longer than an average operation time of the refrigerating cycle.

The foregoing and other embodiments can each optionally include one or more of the following features, alone or in combination. In particular, one embodiment includes all the following features in combination. The controller is configured to, based on a determination that the first compressor is operating while the second compressor does not operate, control an rpm of the radiating fan at a first value that reduces an amount of heat radiated from the first refrigerant passing through the refrigerant channel. The controller is configured to, based on a determination that the second compressor is operating while the first compressor does not operate, control the rpm of the radiating fan at a second value that is larger than the first value. The refrigerator further includes a humidity sensor located on a front surface of the refrigerator, wherein the controller is configured to, based on a determination that the first compressor is operating while the second compressor does not operate and a determination that humidity at the front surface of the refrigerator sensed by the humidity sensor satisfies a preset value, control the rpm of the radiating fan at the first value, and wherein the controller is configured to, based on a determination that humidity at the front surface of the refrigerator sensed by the humidity sensor does not satisfy a preset value, control the rpm of the radiating fan at the second value. The controller is configured to, based on a determination that both of the first compressor and the second compressor are operating, control the rpm of the radiating fan at a third value that is larger than the second value. The controller is configured to perform operations including determining whether a certain time lapses after the rpm of the radiating fan is set at the third value, and reducing the rpm of the radiating fan based on the determination. The controller is configured to, based on a determination that the first compressor and the second compressor are not operating, control the rpm of the radiating fan at a fourth value that is smaller than the first, the second, and the third values. The controller is configured to, based on a determination that the first compressor and the second compressor are not operating, turn off the radiating fan. The controller is configured to sense an amount of an electrical load of the radiating fan, and wherein the controller is configured to, based on a determination that the sensed amount of the electrical load of the radiating fan is more than satisfies a reference value, reduce the rpm of the radiating fan. The first value is 930 RPM, the second value is 1090 RPM, and the third value is 1300 RPM. The refrigerator further includes a first evaporator, wherein the refrigerant channel is located between the first condenser and the first evaporator. Refrigerant passes through the refrigerant channel during the freezing cycle, and a refrigerant does not pass through the refrigerant channel during the refrigerating cycle.

In general, one innovative aspect of the subject matter described in this specification can be embodied in methods that include the actions of determining whether a freezing cycle or a refrigerating cycle are operated; and controlling a radiating fan for a first condenser and a second condenser during the freezing cycle or the refrigerating cycle based on a determination that the freezing cycle or the refrigerating cycle is operated, wherein a refrigerant channel, located between a body and a door of the refrigerator, operates during the freezing cycle, wherein the refrigerant channel is coupled to the first condenser, and wherein, for a predetermined time interval, an average operation time of the freezing cycle is longer than an average operation time of the refrigerating cycle.

The foregoing and other embodiments can each optionally include one or more of the following features, alone or in combination. In particular, one embodiment includes all the following features in combination. The controlling a radiating fan includes controlling, based on a determination that the freezing cycle is operated while the refrigerating cycle is not operated, an rpm of the radiating fan at a first value to reduce an amount of heat radiated from a refrigerant passing through the refrigerant channel. The controlling a radiating fan includes controlling, based on a determination that the refrigerating cycle is operated while the freezing cycle is not operated, the rpm of the radiating fan at a second value that is larger than the first value. The method further includes sensing humidity at a front surface of the refrigerator, wherein the controlling a radiating fan including: controlling, based on a determination that the first compressor is operating while the second compressor does not operate and a determination that humidity at the front surface of the refrigerator sensed by the humidity sensor satisfies a preset value, the rpm of the radiating fan at the second value that is larger than the first value. The controlling a radiating fan includes controlling, based on a determination that both of the first and second compressors are operating, the rpm of the radiating fan at a third value that is larger than the second value. The controlling a radiating fan includes controlling, based on a determination that the freezing cycle and the refrigerating cycle are not operated, the rpm of the radiating fan at a fourth value that is smaller than the first value, the second value, and the third value. The controlling a radiating fan includes sensing an amount of an electrical load of the radiating fan; and reducing the rpm of the radiating fan when the sensed amount of the electrical load of the radiating fan satisfies a reference value. The first value is 930 RPM, the second value is 1090 RPM, and the third value is 1300 RPM.

The details of one or more examples of the subject matter described in this specification are set forth in the accompanying drawings and the description below. Other potential features, aspects, and advantages of the subject matter will become apparent from the description, the drawings, and the claim.

BRIEF DESCRIPTION OF THE DRAWINGS

Like reference numbers and designations in the various drawings indicate like elements.

DETAILED DESCRIPTION

A refrigerator may include a freezing chamber and a refrigerating chamber that are divided by a barrier filled with an insulator.

During the cool air supplying process, cool air heat-exchanged with a refrigerant of a low temperature and a low pressure in an evaporator is partially supplied into the freezing chamber or the refrigerating chamber by a blower.

The cool air supplied into the refrigerating chamber free-falls through a cool air duct installed at a rear side of the refrigerating chamber in a lengthwise direction. Then, the cool air is discharged from a rear side of the refrigerator toward a front side of the refrigerator, through a plurality of cool air discharge openings formed on a front surface of the cool air duct.

Through such processes, the cool air supplied to at least one of the freezing chamber and the refrigerating chamber has a high temperature through a contact with food stored in the freezing chamber or the refrigerating chamber. Then, the air of a high temperature moves to a peripheral region of the evaporator, through a return duct formed in the barrier.

Each of the freezing chamber and the refrigerating chamber is configured to be open and closed by a door, and a door basket for storing food is installed in the refrigerating chamber door with multi stages.

Next, a process to supply cool air to each part of the refrigerating chamber will be explained in more detail. A damper is installed in the cool air duct into which cool air heat-exchanged in the evaporator is introduced, and a cool air shielding film is installed at the damper. The damper is driven based on a temperature sensed by temperature sensors provided on right and left walls inside the refrigerating chamber. As the cool air shielding film is open and closed, cool air is introduced into the cool air duct. A flow path along which cool air is transferred to each part of the refrigerating chamber is formed in the cool air duct.

Figure 1:
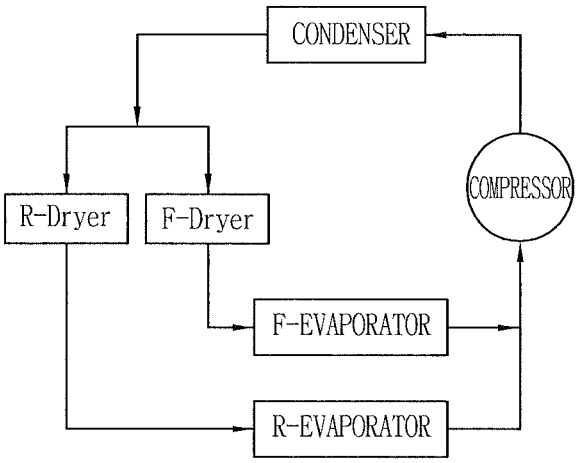
FIG. 1 is a diagram illustrating example two cooling cycles of a refrigerator.

FIG. 1 illustrates example two cooling cycles of a refrigerator. The two cooling cycles include a first cooling cycle and a second cooling cycle. The same compressor and condenser can be used for the first cooling cycle and the second cooling cycle.

In some implementations, the first cooling cycle may be implemented by a compressor, a condenser, a first evaporator, a first dryer, and a first capillary tube. On the other hand, the second cooling cycle may be implemented by the compressor, the condenser, a second evaporator, a second dryer and a second capillary tube.

In some other implementations, the first and second cooling cycles can be implemented by the same compressor and condenser. Once a controller of the refrigerator operates the compressor in order to cool inside of the refrigerator, a refrigerant compressed by the compressor may become a super coolant fluid having a high temperature of about 35□, while passing through the condenser. If the first cooling cycle is operated, the controller may be configured to control the compressed refrigerant to pass through the first dryer. The first dryer may filter moisture and impurities from the compressed refrigerant. Further, the refrigerant may become a refrigerant having a low pressure and a low dryness while passing through the first capillary tube. The refrigerant of a low dryness may have an evaporation temperature of about −90□ while passing through the first evaporator, and then may return to the first compressor.

During the second cooling cycle, the controller may be configured to control the compressed refrigerant to pass through the second dryer, the second capillary tube, and the second evaporator. A temperature of the refrigerant at the compressor, the condenser, the first evaporator and the second evaporator may be variable based on setting information of the refrigerator.

Figure 2A:
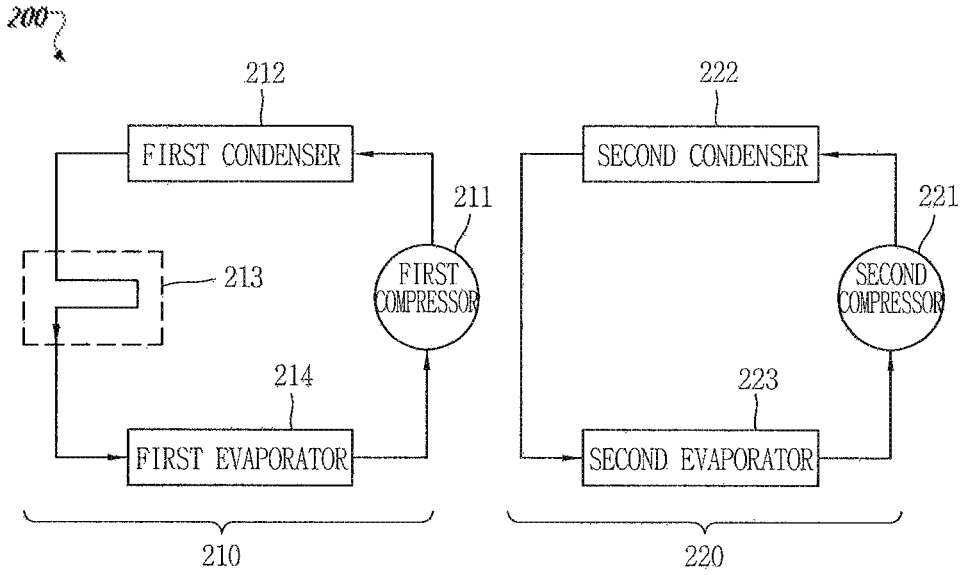
FIGS. 2A and 2B are diagrams illustrating example two cooling cycles of a refrigerator.
Figure 2B:
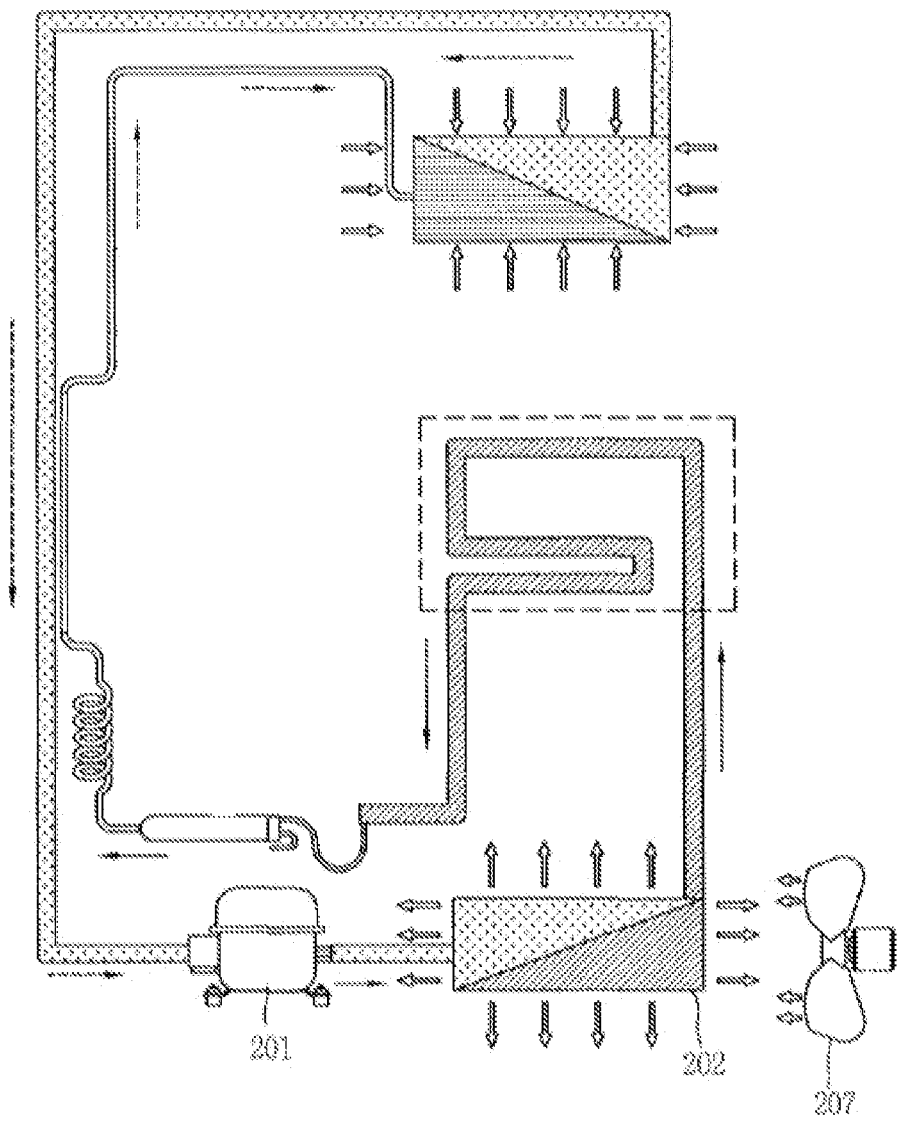

FIGS. 2A and 2B illustrates example operations of two cooling cycles in a refrigerator 200.

As shown in FIG. 2A, the refrigerator 200 may operate on two cooling cycles 210, 220. During the first cooling cycle 210, a refrigerant compressed by a first compressor 211 returns to the first compressor 211 via a first condenser 212 and a first evaporator 214. In particular, the first cooling cycle 210 may be provided with a refrigerant channel 213 disposed between a body and a door. For example, the refrigerant channel 213 may be provided between the first condenser 212 and the first evaporator 214.

During the second cooling cycle 220, a refrigerant compressed by a second compressor 221 returns to the second compressor 221 via a second condenser 222 and a second evaporator 223.

Referring to FIG. 2A, different compressors 211, 221 can be used for each of the first and second cooling cycles 210, 220. In some implementations, as shown in FIG. 1, a same compressor can be used for a first and a second cooling cycles.

Referring back to FIG. 2A, the first and second evaporators 214, 223 may be configured to evaporate a refrigerant after heat-exchanging the refrigerant with air inside the refrigerator 200. Evaporator inlet passages, along which a refrigerant having passed through a capillary tube is guided to the evaporators, may be connected to the evaporators 214, 223. The evaporators 214, 223 can be connected to the compressors 211, 221 through the evaporator inlet passages. A refrigerant evaporated by the evaporators 214, 223 may be sucked into the compressors 211, 221 through connection passages between the evaporators 214, 223 and the compressors 211, 221. The evaporators 214, 223 may be installed on an external wall of an inner casing, or may be installed in the inner casing.

In some implementations, the refrigerator may be configured as a direct-cooling type refrigerator for cooling an inner casing by an evaporator, and for cooling a storage chamber by convection and natural convection of air inside the refrigerator.

In some other implementations, the refrigerator may be configured as an indirect-cooling type refrigerator for cooling a storage chamber as air inside the refrigerator circulates the storage chamber and an evaporator in a forcible manner, the evaporator installed outside the storage chamber. The refrigerator may further include an evaporator fan for blowing air inside the refrigerator to the evaporator.

The compressors 211, 221 may suck a refrigerant evaporated by the evaporators 214, 223, compress the sucked refrigerant, and then discharge the compressed refrigerant. The compressors 211, 221 may be connected to the condensers 212, 222 through connection passages between the compressors 211, 5 221 and the condensers 212, 222. The refrigerant compressed by the compressors 211, 221 may be guided to the condensers 212, 222 through the connection passages between the compressors 211, 221 and the condensers 212, 222. The compressors 211, 221 may be installed at a mechanical chamber of the refrigerator 200.

The condensers 212, 222 may condense a refrigerant compressed by the compressors 211, 221. Condenser outlet passages, through which a refrigerant having passed through the condensers 212, 222 flows, may be connected to the condensers 212, 222. The condenser outlet passage may be connected to an outlet of each condenser. The condensers 212, 222 may be installed at a mechanical chamber of the refrigerator, or may be installed to be exposed to the outside of the refrigerator. The mechanical chamber may be provided with a mechanical chamber fan for radiating heat of a refrigerant passing through the condensers 212, 222. The mechanical chamber fan may correspond to a radiating fan with respect to a refrigerant which circulates along the first and second cooling cycles.

The refrigerant channel 213 may be installed such that a refrigerant having passed through the first condenser 212 removes dew inside the refrigerator 200 by evaporating the dew. The refrigerant channel 213 may be installed at a contact part between the body and the door. The refrigerant channel 213 may include a refrigerant pipe installed at a contact part between the body and the door. The refrigerant channel 213 may be installed between an outer casing and an inner casing of the body, and may be configured to radiate heat through the outer casing. A gaseous refrigerant, among a refrigerant having passed through the condenser, may be condensed by radiating heat while the gaseous refrigerant passes through the refrigerant channel 213. Dew formed at a contact part between the body and the door may be removed by heat of the refrigerant channel 213. A refrigerant may pass through the refrigerant channel 213 when the first cooling cycle 210 is operated and the second cooling cycle is not operated. While the second cooling cycle 220 is operated, a refrigerant may not pass through the refrigerant channel 213.

FIG. 2B illustrates an example first cooling cycle. As shown in FIG. 2B, a compressor 201 and a condenser 202 for the first cooling cycle may be arranged at a mechanical chamber. A refrigerant passing through the condenser 202 may radiate heat by a radiating fan 207, e.g. a mechanical chamber fan, of the mechanical chamber. The controller may control an amount of heat radiated from a refrigerant passing through the condenser by controlling an rpm of the radiating fan 207.

Figure 3:
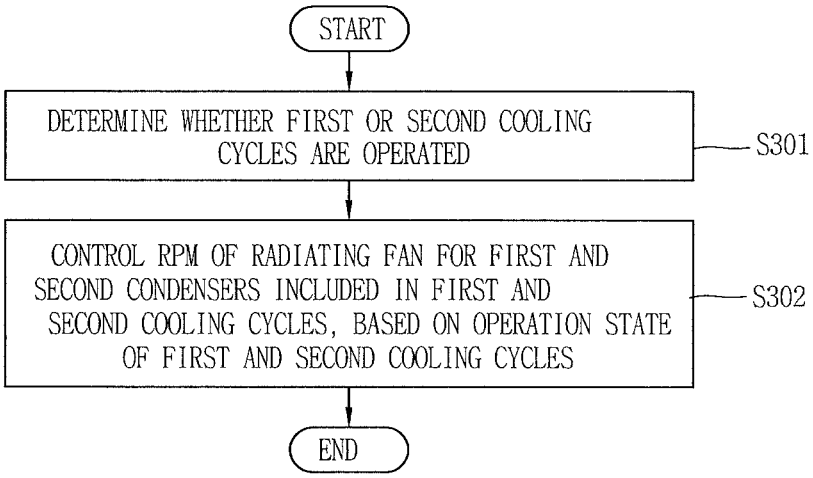
FIG. 3 is a flowchart illustrating an example method for controlling a refrigerator on two cooling cycles.

FIG. 3 illustrates an example method of controlling a refrigerator operating on two cooling cycles. As shown in FIG. 3, a controller of the refrigerator may determine whether first and second cooling cycles are operated (S301). In particular, the controller may determine whether the first and second cooling cycles are operated, based on information on an operation state of the first and second compressors. If the first compressor is being operated, the controller may determine that the first cooling cycle is being operated. If the second compressor is being operated, the controller may determine that the second cooling cycle is being operated.

The controller may turn on/off the first and second compressors. The controller may turn on/off the first compressor by determining whether a condition for driving the first cooling cycle has been satisfied. Likewise, the controller may turn on/off the second compressor by determining whether a condition for driving the second cooling cycle has been satisfied.

Then, the controller may control a rotation speed (rpm) of the radiating fan for the first and second condensers included in the first and second cooling cycles, based on an operation state of the first and second cooling cycles (S302).

In particular, when the first cooling cycle is operated and the second cooling cycle is not operated, the controller may control the rpm of the radiating fan into a preset first value, such that a heat radiation amount of a refrigerant passing through the refrigerant channel at the first condenser is reduced.

Further, when both of the first and second cooling cycles are operated, the controller may control the rpm of the radiating fan into a third value larger than the first and second values.

For instance, the preset first value may be 930 RPM, the preset second value may be 1090 RPM, and the preset third value may be 1300 RPM. However, the preset first to third values related to a rotation speed (rpm) of the radiating fan are not limited to this, but may be set with consideration of power efficiency of the refrigerator, etc.

Figure 4:
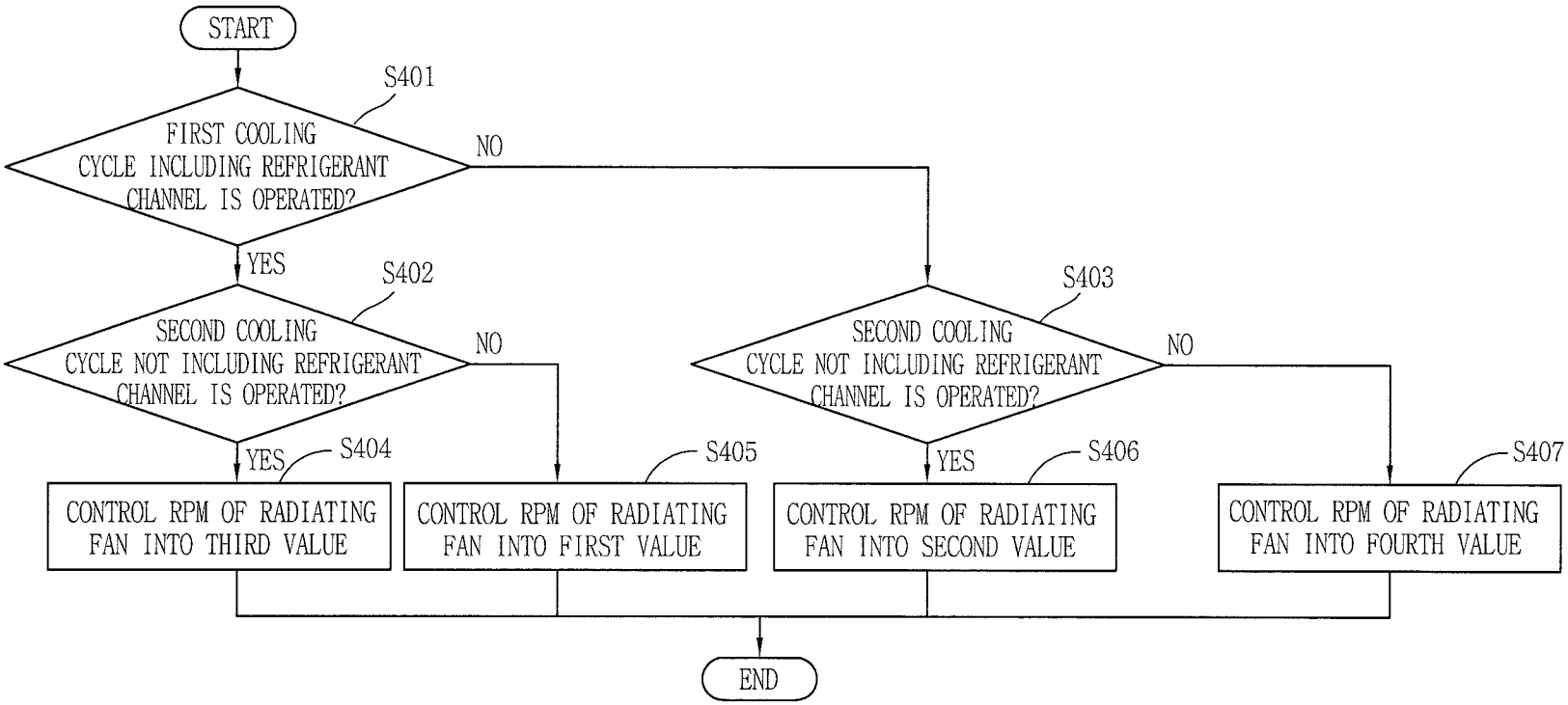
FIGS. 4 and 5 are flowcharts illustrating example methods of controlling a refrigerator on two cooling cycles.
Figure 5:
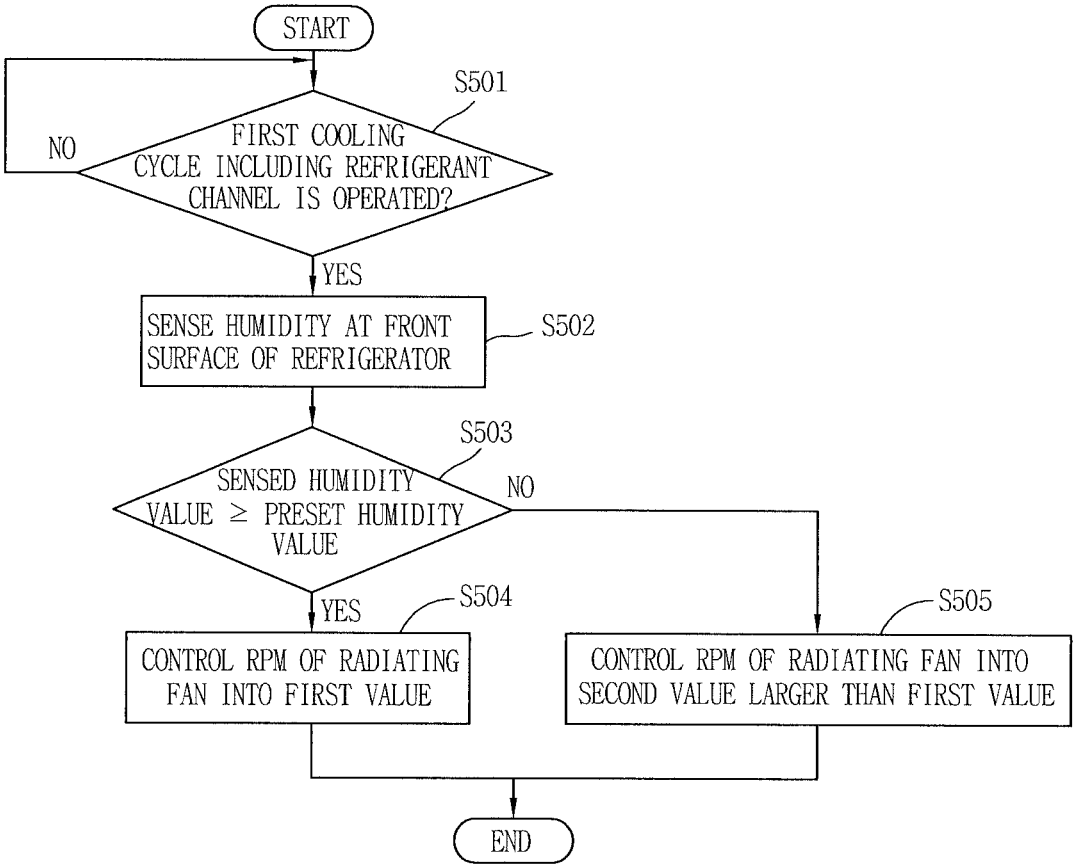

FIGS. 4 and 5 illustrate flowcharts for example methods of controlling a refrigerator on two cooling cycles. The controller may determine whether the first cooling cycle including a refrigerant channel is operated or not (S401). Then, the controller may determine whether the second cooling cycle not including the refrigerant channel is operated or not (S402, S403).

And the controller may control the rpm of the radiating fan based on an execution result of the steps S401, S402, S403 (S404, S405, S406, S407).

In particular, when the first cooling cycle is operated and the second cooling cycle is not operated, the controller may control the rpm of the radiating fan into a first value (S404). When the second cooling cycle is operated and the first cooling cycle is not operated, the controller may control the rpm of the radiating fan into a second value (S405). When both of the first and second cooling cycles are operated, the controller may control the rpm of the radiating fan into a third value (S406). If neither the first cooling cycle nor the second cooling cycle is operated, the controller may control the rpm of the radiating fan into a fourth value (S407).

In some implementations, the first to fourth values may be preset values related to the rpm of the radiating fan. The preset first value may be smaller than an rpm of a radiating fan of a refrigerator having a single cooling cycle. With such a configuration, even if a time duration for driving the refrigerant channel is reduced more than in a refrigerator having a single cooling cycle, dew condensation to generated between the body and the door may be prevented.

The second value may be configured to be larger than the first value. For example, if the first cooling cycle being operated is converted into the second cooling cycle not including the refrigerant channel, the controller may increase the rpm of the radiating fan to the second value from the first value (S405). As the rpm of the radiating fan is increased to the second value from the first value, a heat radiation amount of a refrigerant passing through the second condenser when the second cooling cycle is operated, may be larger than that of a refrigerant passing through the first condenser when the first cooling cycle is operated. That is, a refrigerant temperature of the second cooling cycle may be lower than that of the first cooling cycle. This may allow power efficiency of the refrigerator to be increased when the second cooling cycle is operated.

In some implementations, the first cooling cycle may correspond to a freezing cycle (F-cycle), and the second cooling cycle may correspond to a refrigerating cycle (R-cycle). In some other implementations, for a predetermined time interval, an average operation time of a freezing cycle may be longer than an average operation time of a refrigerating cycle. That is, a ratio between an operation time of the first cooling cycle and an operation time of the second cooling cycle, for a predetermine time interval, may be 7:3.

For example, the first cooling cycle may represent a freezing cycle, and the second cooling cycle may represent a refrigerating cycle, and vice versa.

In the example below, for convenience, a first cooling cycle may represent a freezing cycle, and a second cooling cycle' may represent a refrigerating cycle.

During the freezing cycle, cool air may be supplied to the freezing chamber of the refrigerator. During the refrigerating cycle, cool air may be supplied to the refrigerating chamber of the refrigerator.

The third value may be larger than the first and second values. For example, when both of the first and second cooling cycles are operated, the controller may increase the rpm of the radiating fan into the third value from the first value or the second value (S406).

More specifically, the controller senses a change amount of a load inside the refrigerator, and may operate both of the first and second cooling cycles when the change amount of the load exceeds a reference value as a sensing result. The controller may control the rpm of the radiating fan into the third value.

In some implementations, if a predetermined time lapses after the rpm of the radiating fan has been set into the third value, the controller may reduce the rpm of the radiating fan.

The fourth value may be smaller than the first to third values. That is, if neither the first cooling cycle nor the second cooling cycle is operated, the controller may reduce the rpm of the radiating fan into the fourth value (S407). In some implementations, if it is determined that neither the first cooling cycle nor the second cooling cycle is operated, the controller may turn off the radiating fan to control the rpm of the radiating fan into '0'.

If a sensed amount of an electrical load of the radiating fan is more than a reference value, the controller may reduce the rpm of the radiating fan, or may turn off the radiating fan.

Referring to FIG. 5, the controller may determine whether the first cooling cycle including the refrigerant channel is operated (S501).

A humidity sensor disposed on a front surface of the refrigerator may sense a humidity at the front surface of the refrigerator (S502). More specifically, the humidity sensor may sense a humidity at a contact part between the body and the door. Further, the humidity sensor may sense a humidity in a specific space adjacent to a contact part between the body and the door.

The controller may compare a humidity sensed by the humidity sensor with a preset humidity value (S503). In this case, the preset humidity value may be set according to an external temperature and a pressure of the refrigerator. As the external temperature and the pressure of the refrigerator are changed, the controller may change the preset humidity value. The preset humidity value may be set according to a user's input.

If the humidity at the front surface of the refrigerator is more than a preset value as a sensing result by the humidity sensor, the controller may control the rpm of the radiating fan into the first value (S504).

On the other hand, if the humidity at the front surface of the refrigerator is less than the preset value as a sensing result by the humidity sensor, the controller may control the rpm of the radiating fan into the second value larger than the first value (S505).

More specifically, if it is determined that dew condensation is not generated at a contact part between the body and the door, based on information sensed by the humidity sensor without operating the refrigerant channel, the controller may increase the rpm of the radiating fan into the second value from the first value.

The controller may determine an operation time of the refrigerant channel, based on information sensed by the humidity sensor. That is, if a humidity value sensed by the humidity sensor is larger than a reference value, the controller may increase an operation time of the refrigerant channel. On the contrary, if the humidity value sensed by the humidity sensor is smaller than the reference value, the controller may decrease the operation time of the refrigerant channel.

A temperature sensor and a pressure sensor may be further provided on the front surface of the refrigerator. In this case, the controller may control the rpm of the radiating fan based on information sensed by the temperature sensor and the pressure sensor.

More specifically, the controller may calculate a difference between a temperature value sensed by the temperature sensor and a temperature value of the body. Then, the controller may control the rpm of the radiating fan or may determine an operation time of the refrigerant channel, according to a result of the calculation.

Figure 6:
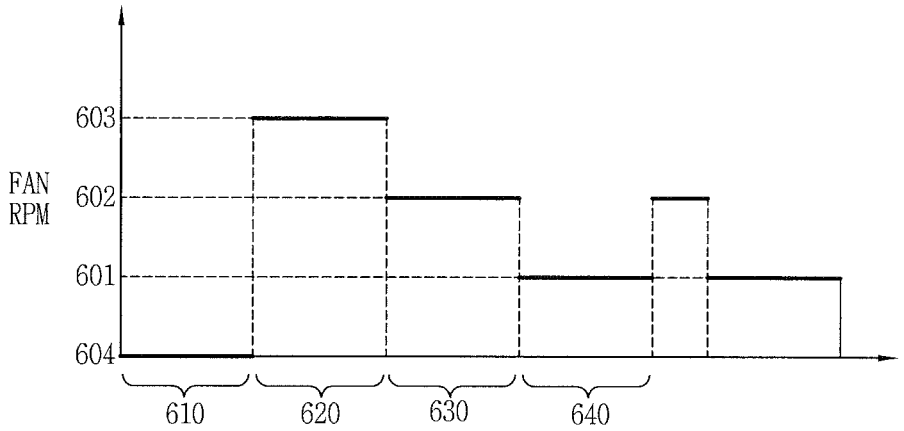
FIG. 6 is a graph illustrating an example rpm of a mechanical chamber fan per unitary time.

FIG. 6 illustrates a graph of a rotation speed of a mechanical chamber fan per unitary time. when the first cooling cycle is operated and the second cooling cycle is not operated (640), the controller may control the rpm of the radiating fan (mechanical chamber fan) into the first value (601). When the second cooling cycle is operated and the first cooling cycle is not operated (630), the controller may control the rpm of the radiating fan into the second value (602) larger than the first value. When both of the first and second cooling cycles are operated (620), the controller may control the rpm of the radiating fan into the third value (603) larger than the first and second values. When neither the first cooling cycle nor the second cooling cycle is operated (610), the controller may control the rpm of the radiating fan into the fourth value (604) smaller than the first, the second, and the third values. For instance, the first value may be 930 RPM, the second value may be 1090 RPM, the third value may be 1300 RPM, and the fourth value may be 0 RPM. However, the first to fourth values may be differently set according to a user's input for controlling performance or the rpm of the radiating fan.

Some examples of the subject matter described in this specification can be implemented so as to realize one or more of the following advantages. An rpm of a radiating fan of a refrigerator operating on two cooling cycles is controlled. This may prevent occurrence of dew condensation between a body and a door of the refrigerator. Further, power efficiency of the refrigerator may be enhanced.

What is claimed is:

1. A refrigerator, comprising:

a first compressor configured to compress a first refrigerant;

a first condenser configured to return the first refrigerant to the first compressor during a freezing cycle;

a second compressor configured to compress a second refrigerant;

a second condenser configured to return the second refrigerant to the second compressor during a refrigerating cycle, wherein the refrigerating cycle is separated from the freezing cycle;

a controller configured to:

determine an operation state of the freezing cycle based on operation of the first compressor, after the determination of the operation state of the freezing cycle, determine an operation state of the refrigerating cycle based on operation of the second compressor, and control a radiating fan for the first condenser and the second condenser based on at least one of the operation state of the freezing cycle or the operation state of the refrigerating cycle; and a refrigerant channel defined by a refrigerant pipe that is connected to the first condenser and configured to circulate the first refrigerant, wherein the controller is configured to:

control the first compressor and the second compressor for a predetermined time interval such that a sum of operation time of the first compressor in the freezing cycle is longer than a sum of operation time of the second compressor in the refrigerating cycle, control a revolutions per minute (rpm) of the radiating fan based on the at least one of the operation state of the freezing cycle or the operation state of the refrigerating cycle, in a freezing-only state in which the freezing cycle is operated and the refrigerating cycle is not operated, control the rpm of the radiating fan to a first value, in a refrigerating-only state in which the freezing cycle is not operated and the refrigerating cycle is operated, control the rpm of the radiating fan to a second value greater than the first value, in a freezing-refrigerating state in which both of the freezing cycle and the refrigerating cycle are operated, control the rpm of the radiating fan to a third value greater than the second value, in the freezing-only state, control the rpm of the radiating fan to the first value based on a determination that a humidity sensed at a front surface of the refrigerator satisfies a preset value, in the freezing-only state, control the rpm of the radiating fan to the second value based on a determination that the humidity sensed at the front surface of the refrigerator does not satisfy the preset value, increase an operation time of the refrigerant channel based on a determination that the humidity sensed at the front surface of the refrigerator is greater than a reference value, and decrease the operation time of the refrigerant channel based on a determination that the humidity sensed at the front surface of the refrigerator is less than the reference value.

2. The refrigerator of claim 1, wherein, the controller is configured to, based on a determination that the first compressor is operating while the second compressor does not operate, determine that the refrigerator is in the freezing-only state and control the rpm of the radiating fan to the first value to thereby reduce an amount of heat radiated from the first refrigerant in the refrigerant channel.

3. The refrigerator of claim 2, wherein the controller is configured to, based on a determination that the second compressor is operating while the first compressor does not operate, determine that the refrigerator is in the refrigerating-only state and control the rpm of the radiating fan to the second value.

4. The refrigerator of claim 3, wherein the controller is configured to, based on a determination that both of the first compressor and the second compressor are operating, determine that the refrigerator is in the freezing-refrigerating state and control the rpm of the radiating fan to the third value.

5. The refrigerator of claim 4, wherein the controller is configured to:

determine whether a certain time lapses after the rpm of the radiating fan is set at the third value, and decrease the rpm of the radiating fan based on the determination that the certain time has lapsed.

6. The refrigerator of claim 4, wherein the controller is configured to, based on a determination that the first compressor and the second compressor are not operating, control the rpm of the radiating fan at a fourth value that is smaller than the first, the second, and the third values.

7. The refrigerator of claim 4, wherein the controller is configured to, based on a determination that the first compressor and the second compressor are not operating, turn off the radiating fan.

8. The refrigerator of claim 4, wherein the controller is configured to:

sense an amount of an electrical load of the radiating fan; and based on a determination that the sensed amount of the electrical load of the radiating fan is more than satisfies a reference load, reduce the rpm of the radiating fan to the third value.

9. The refrigerator of claim 4, wherein the first value is 930 rpm, the second value is 1090 rpm, and the third value is 1300 rpm.

10. The refrigerator of claim 1, further comprising:

a first evaporator, wherein the refrigerant channel is located between the first condenser and the first evaporator.

11. The refrigerator of claim 5, wherein the first refrigerant is circulated through the refrigerant channel during the freezing-only state and the freezing-refrigerating state, and stops being circulated through the refrigerant channel during the refrigerating-only state.

12. A method for controlling a refrigerator that includes a first compressor configured to compress a first refrigerant, a second compressor configured to compress a second refrigerant, the method comprising:

determining an operation state of a freezing cycle based on operation of the first compressor;

after the determination of the operation state of the freezing cycle, determining an operation state of a refrigerating cycle based on operation of the second compressor;

controlling the first compressor and the second compressor for a predetermined time interval such that a sum of operation time of the first compressor in the freezing cycle is longer than a sum of operation time of the second compressor in the refrigerating cycle;

controlling a radiating fan for a first condenser and a second condenser during the freezing cycle or the refrigerating cycle based on a determination that the freezing cycle or the refrigerating cycle is operated;

sensing a humidity at a front surface of the refrigerator; and controlling a refrigerant channel defined by a refrigerant pipe that is connected to the first condenser and configured to circulate the first refrigerant, the second refrigerant being separately cycled from the first refrigerant, wherein controlling the radiating fan comprises controlling a revolution per minute (rpm) of the radiating fan based on at least one of the operation state of the freezing cycle or the operation state of the refrigerating cycle, and wherein controlling the rpm of the radiating fan comprises:

in a freezing-only state in which the freezing cycle is operated and the refrigerating cycle is not operated, controlling the rpm of the radiating fan to a first value, in a refrigerating-only state in which the freezing cycle is not operated and the refrigerating cycle is operated, controlling the rpm of the radiating fan to a second value greater than the first value, in a freezing-refrigerating state in which both of the freezing cycle and the refrigerating cycle are operated, controlling the rpm of the radiating fan to a third value greater than the second value, in the freezing-only state, controlling the rpm of the radiating fan to the first value based on a determination that the humidity sensed at the front surface of the refrigerator satisfies a preset value, increasing an operation time of the refrigerant channel based on a determination that the humidity sensed at the front surface of the refrigerator is greater than a reference value, and decreasing the operation time of the refrigerant channel based on a determination that the humidity sensed at the front surface of the refrigerator is less than the reference value.

13. The method of claim 12, wherein controlling the radiating fan comprises:

controlling, in the freezing-only state, the rpm of the radiating fan to the first value to thereby reduce an amount of heat radiated from the first refrigerant in the refrigerant channel.

14. The method of claim 12, wherein controlling the radiating fan comprises:

based on a determination that both of the first and second compressors are operating, the determining that the refrigerator is in the freezing-refrigerating state and controlling the rpm of the radiating fan to the third value.

15. The method of claim 14, wherein controlling the radiating fan comprises:

controlling, based on a determination that the freezing cycle and the refrigerating cycle are not operated, the rpm of the radiating fan at a fourth value that is less than the first value, the second value, and the third value.

16. The method of claim 13, wherein controlling the radiating fan comprises:

sensing an amount of an electrical load of the radiating fan; and reducing the rpm of the radiating fan when the sensed amount of the electrical load of the radiating fan satisfies a reference load.

17. The method of claim 14, wherein the first value is 930 rpm, the second value is 1090 rpm, and the third value is 1300 rpm.

18. The refrigerator of claim 1, wherein the first value is preset to be less than an rpm of a radiating fan of a refrigerator having a single cooling cycle.

* * * * *